United States Patent [19]

Dodson

[11] B 3,981,059

[45] Sept. 21, 1976

[54] TEXTILE COT

[75] Inventor: Walter L. Dodson, Canton, N.C.

[73] Assignee: Dayco Corporation, Dayton, Ohio

[22] Filed: Sept. 30, 1974

[21] Appl. No.: 510,855

[44] Published under the second Trial Voluntary Protest Program on January 27, 1976 as document No. B 510,855.

[52] U.S. Cl. ..... 29/127

[51] Int. Cl.[2] ..... B21B 31/08

[58] Field of Search ..... 29/127, 130, 132

[56] References Cited

UNITED STATES PATENTS

| | | | |
|---|---|---|---|
| 954,055 | 4/1910 | Smith | 29/127 X |
| 1,092,775 | 4/1914 | Kempshall | 29/132 |
| 2,046,136 | 6/1936 | St. Claire | 29/127 |
| 2,046,137 | 6/1936 | Prentis | 29/127 |
| 2,597,858 | 5/1952 | Freedlander | 29/130 |
| 2,960,749 | 11/1960 | Robertson et al. | 29/127 X |
| 3,173,172 | 3/1963 | Pasquetti | 29/200 B |
| 3,229,352 | 1/1966 | Balkin et al. | 29/132 |
| 3,308,523 | 3/1967 | Ivester et al. | 29/127 |
| 3,593,398 | 7/1971 | Hess et al. | 29/132 |

*Primary Examiner*—Alfred R. Guest

*Attorney, Agent, or Firm*—Reuben Wolk

[57] ABSTRACT

A textile cot and method of making same is provided wherein such cot has an elastomeric outer portion and a core supporting the outer portion with the core being at least one helically wound elongated strip capable of being expanded radially a sufficient amount to provide a press fit against an associated cylindrical supporting roller.

15 Claims, 16 Drawing Figures

TEXTILE COT

BACKGROUND OF THE INVENTION

In the textile industry textile fibers are drafted or drawn to produce yarn, sliver, roving, and the like and so-called cots are employed for this purpose. One type of cot in common use includes a sleeve-like supporting core of uniform thickness throughout and such core has smooth inside and outside surfaces and has an outer working surface made of an elastomeric material.

In general, with a cot of the character mentioned agove, the sleeve-like core has a fixed dimension whereby such core is only usable with an elastomeric outer portion of a particular size which is usually adhesively bonded thereon. This type of core is also usually made by extruding an entire tube structure through an associated die and such tube structure is then cut into desired lengths whereby each cut length has a comparatively weak hoop strength and a limited capability for radial expansion.

SUMMARY

This invention provides an improved cot and method of making same wherein such cot is comprised of an elastomeric outer portion and a core supporting the outer portion; and, the core is a helically wound elongated strip means capable of being expanded radially a sufficient amount to provide a press fit against an associated cylindrical supporting structure or roller. By making the core utilizing an elongated helically wound strip means, the same strip means may be used to make cores having different diameters and axial lengths simply by helically winding the elongated strip means around a tool or sizing mandrel having the desired diameter. Further, the core may be made from plastic strip means which has a plurality of randomly arranged strenghening fibers embedded therein in roughly parallel relation along its length so that once such strip means is helically wound to define a core the fibers thereof provide improved hoop strength for such core.

Other details, uses, and advantages of this invention will be readily apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
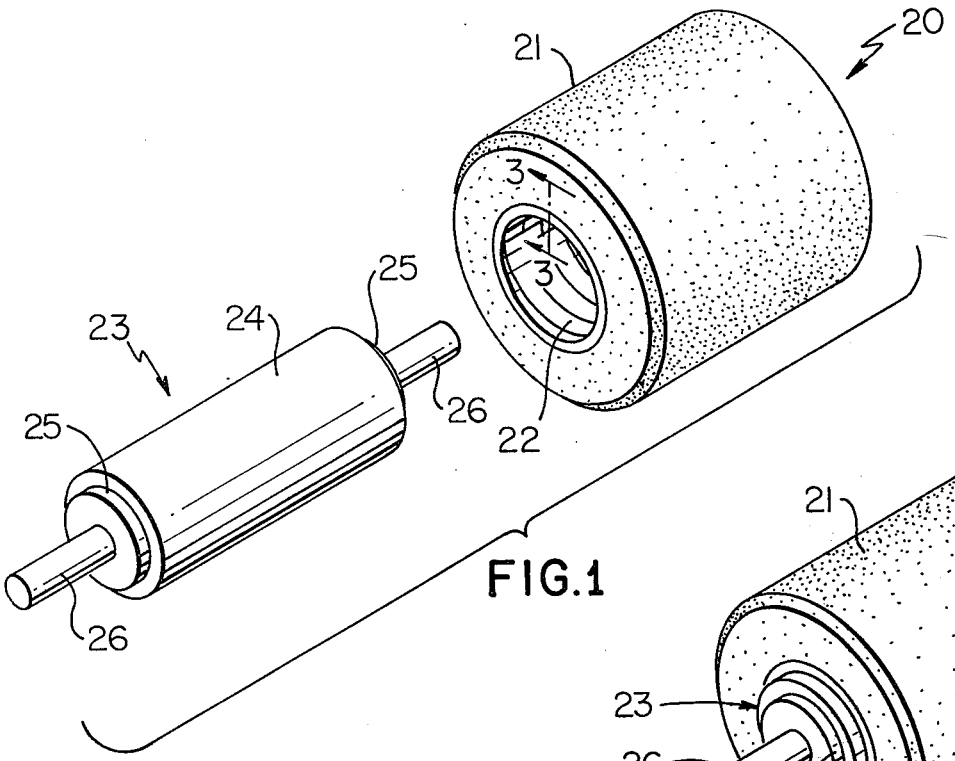
FIG. 1 is an exploded perspective view illustrating one exemplary embodiment of the cot of this invention and an associated cylindrical supporting structure or roller on which such cot is adapted to be mounted or assembled by press fit.
Figure 2:
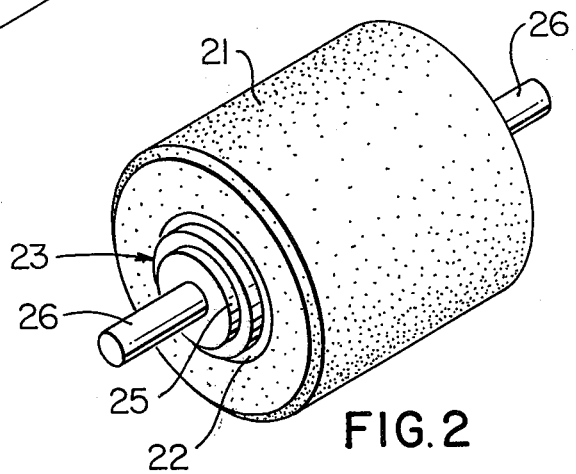
FIG. 2 is a perspective view illustrating the roller and cot of FIG. 1 after assembly thereof.

Reference is now made to FIG. 1 of the drawings which illustrates one exemplary embodiment of a textile cot of this invention which is designated generally by the reference numeral 20 and such cot is of the type that is used in the textile industry for the drafting or drawing of textile fibers, or the like, to produce sliver, roving, yarn, etc. and in accordance with techniques which are well known in the art and such techniques do not require further elaboration herein. The cot 20 comprises an elastomeric outer portion 21 and a core 22 supporting the outer portion 21 with the core being a helically wound elongated strip means forming a continuous interlocking tube capable of being expanded radially a sufficient amount to provide a press fit against an associated cylindrical supporting structure which is shown in this example as an elongated supporting roller 23 which has an outside right circular cylindrical surface 24. The roller 23 may have stepped or reduced diameter opposite end portions 25 and a pair of shaft portions 26 extending from its opposite ends and each of the shaft portions 26 has a right circular cylindrical configuration and is provided as an integral part of the roller 23 either as a single piece construction or as a member which has been fixed thereto. The shaft portions 26 support the roller 23 with the cot 20 thereon on associated machinery and in accordance with techniques known in the art.

The helically wound elongated strip means of the exemplary cot 20 is in the form of a single strip which is also designated by the numeral 22 inasmuch as it defines core 22; and, strip 22 may be made of any suitable elastomeric material and in this example is shown as being made of a synthetic plastic material with the elastomeric outer portion of the cot being made of rubber. The helically wound elongated strip means or core has spaced recesses 27 and projections 28 along its outside surface which define a spiral tread-like outside surface 30 and projections 31 and recesses 29 having the desired diameter and the winding action may be continued until the inside surface which define a spiral tread-like inside surface 33 of such core. The tread-like surfaces 30 and 33 provide optimum adhesion between the core 22 and its associated cylindrical supporting structure or roller 23 and the core 22 and its associated elastomeric outer portion 21. In addition, by making the core of strip means defined by either a single strip or a plurality of strips which are helically wound it is possible to provide a core having any desired diameter or axial length merely by winding such strip means about a suitable tool, fixture, or the like having the desired axial length is provided for such core.

Figure 3:
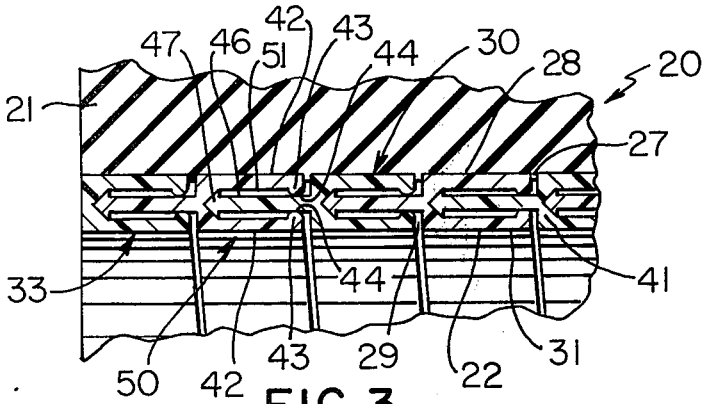
FIG. 3 is a fragmentary view with parts in cross section and parts broken away taken essentially on the line 3—3 of FIG. 1 and which utilizes one embodiment of helically wound elongated strip means to define a core.
Figure 7:
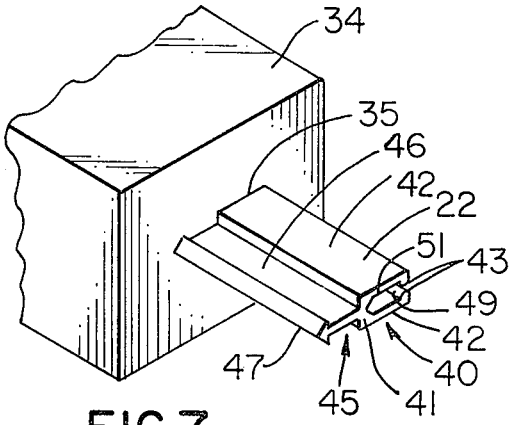
FIG. 7 is a schematic presentation illustrating the forming of an elongated strip by extrusion through an associated extrusion die.

The exemplary core 22 comprising the cot 20 of FIGS. 1 and 3 is made from a single elongated plastic strip which is preferably formed by extrusion process through an associated extrusion die 34, as shown in FIG. 7, with such die having a special die orifice 35 which defines the cross-sectional configuration of the strip; and, as indicated earlier, and to avoid confusion, the same reference numeral 22 has been given to the strip and core. The strip is suitably helically wound as illustrated at 36 in FIG. 8 to define an elongated tubular length of core 22 and such elongated tubular length may be cut using suitable cutting means or devices shown as a pair of spaced cutting knives 37 of known construction as shown in FIG. 9 and then processed further to define a completed tubular core construction 22.

As best seen in FIG. 7 the strip 22 comprises a roughly U-shaped portion 40 defined by a bight 41 and a pair of arms each designated by the reference numeral 42 extending from opposite ends of the bight in one direction with the arms having locking projections 43 extending toward each other and the locking projections 43 are provided at the outer extremities of the arms 42 and have rounded surface portions 44. The strip 22 also has a spear-shaped portion 45 including a shaft 46 and an approximately triangularly-shaped head 47 with the head 47 being pointed in a direction opposite from the direction in which the arms 42 extend from the bight 41. The strip 22 is adapted to be helically wound so that each turn thereof has the head 47 of its spear shaped portion received between the arms 42 with the locking projections 43 against opposed surfaces of the shaft portion 46 and will be readily apparent at 50 in FIG. 3.

The strip 22 which is preferably made of an elastomeric material in the form of a resilient synthetic plastic material and the arms 42 are deflected to receive the spear-shaped portion and then serve resiliently compress the locking projections against the shaft 46 to provide the locking action. The rounded surface portions 44 of the locking projections 43 serve as cam surfaces so that once the wedge-shaped triangular head engages such surfaces they cam their associated resilient arms 42 outwardly and once the head 47 moves past the projections 43 and within the groove 51 defined between the arms 42 such arms return to approximately their original positions with the surfaces 44 firmly in contact against the shaft portion 46.

Figure 8:
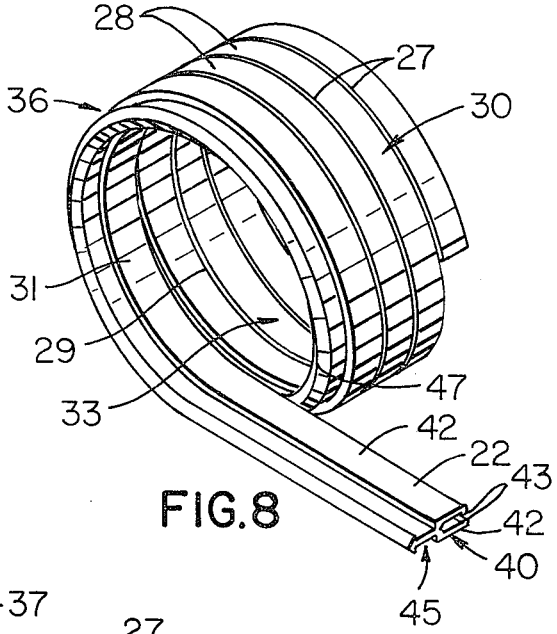
FIG. 8 is a perspective view illustrating the manner in which the extruded strip of FIG. 7 may be helically wound to define a tubular core structure for a cot.
Figure 9:
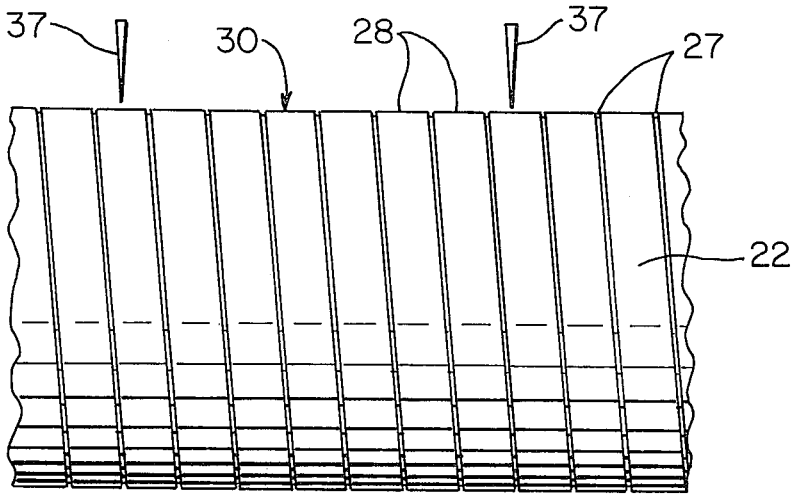
FIG. 9 is a view schematically illustrating the tubular core structure of FIG. 8 being cut to define a core having a predetermined axial length.
Figure 10:
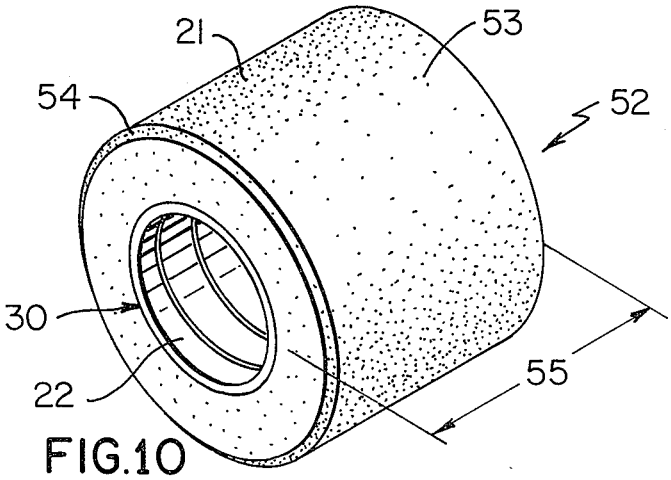
FIG. 10 is a perspective view illustrating the completed cot of this invention after installation of an elastomeric outer portion therearound by any desired technique.

After the strip 22 has been wound as shown in FIG. 8, and cut as shown in FIG. 9 to define the tubular core 22 a suitable elastomeric material is bonded against the outside surface 30 of the core and the completed cot is illustrated at 52 in FIG. 10. As shown in the drawing the core, although originally flexible, is rigid by virtue of the fact that it is bonded to the outer portion 21. It will also be appreciated that the outside surface of the elastomeric outer portion 21 may be quite rough or unfinished initially and then suitably finished by grinding or similar action to define a right circular cylindrical surface 53 for the cot 20 and such outer portion 21 may be provided with beveled edges 54, if desired. It will also be appreciated that the final axial length 55 of the cot need not necessarily by established when the core 22 is cut, but may be achieved by roughly cutting the core as shown in FIG. 9 slightly longer than required, then fixing the outer portion 21 in position and finally cutting or grinding the core 22 and its outer portion simultaneously to define length 55.

Figure 4:
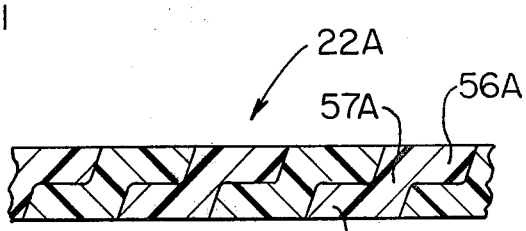
FIG. 4 is a fragmentary cross-sectional view illustrating another exemplary embodiment of an elongated strip means which is helically wound to define a modified core for toe cot of this invention.
Figure 5:
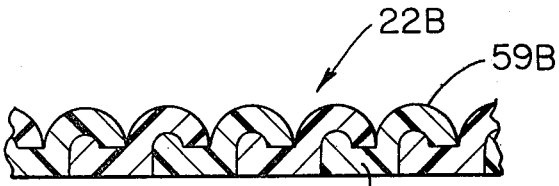
FIG. 5 is a fragmentary cross-sectional view illustrating another exemplary embodiment of an elongated strip means which is helically wound to define another modified core for the cot of this invention.
Figure 6:
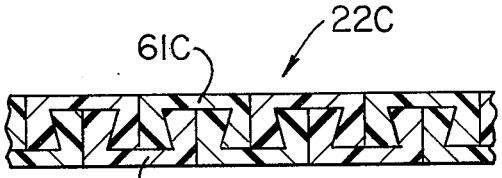
FIG. 6 is a fragmentary cross-sectional view illustrating another exemplary embodiment of an elongated strip means which is helically wound to define still another modified core for the cot of this invention.

Having described the elongated strip utilized to define core 22 of the cot 20 reference is now made to FIGS. 4, 5, and 6 of the drawings which illustrate other exemplary embodiments of elongated strip means in the form of one or more strips which may be helically wound similar to the strip 22 to define a core which may be used interchangeably with the core 22 and for simplicity FIGS. 4, 5, and 6 illustrate the strip means or cores in their wound condition minus associated outer or inner structures and the cores of FIGS. 4, 5, and 6 are designated by the reference numerals 22A, 22B, and 22C respectfully.

The core 22A of FIG. 4 is also in the form of a single helically wound elongated strip which has a cross-sectional configuration approximately similar to the well known structural Zee having a pair of flanges each designated by the reference numeral 56A and extending in opposite directions with flanges 56A being interconnected by an interconnecting flange 57A.

The core 22B of FIG. 5 is also in the form of a single helically wound elongated strip which has a cross-sectional configuration approximately similar to the numeral 5 defined by a roughly U-shaped portion 58B adjoined by an arcuate portion 59B.

The core 22C of FIG. 6 is in the form of a plurality of two helically wound interlocked strips each designated by the reference numeral 61C. The interlocking of strips 61C is achieved simultaneously with the helical winding thereof, and the exemplary strips 61C are U-shaped.

Each of the cores 22A, 22B or 22C may be used interchangeably with the core 22 and once each of these cores 22A–C is provided with a suitable elastomeric outer portion a cot is defined which may be placed on the roller 23 in a similar manner as described in connection with the placement of the cot 20 on the roller 23. It will also be appreciated that each of the cores 22A, 22B, and 22C is capable of being radially expanded a sufficient amount to provide a press fit against its associated cylindrical supporting roller 23.

Figure 13:
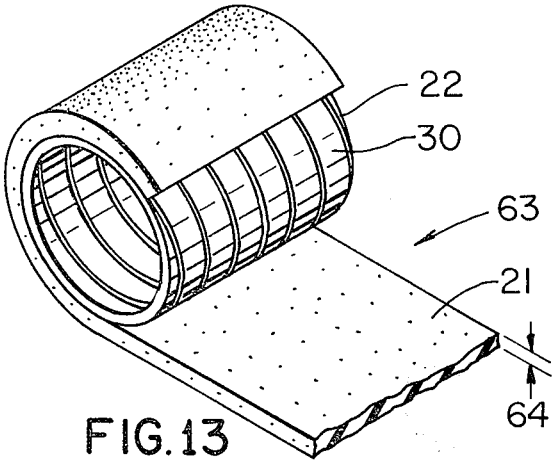
FIG. 13 is a fragmentary perspective view illustrating a core defined in the manner illustrated in FIG. 9 after cutting thereof to a desired length and the forming of an elastomeric outer portion thereagainst by bonding a rectangular sheet of a rubber material against such core.

The elastomeric outer portion 21 may be defined on the cot of this invention using various method steps, some of which will now be described. For example, the cot 20 may be defined by providing a predetermined length of core which has been cut in the manner illustrated in FIG. 9 whereupon an outer portion in the form of a rectangular sheet 21 of uncured rubber material may be wound therearound as shown at 63 in FIG. 13 and bonded against the core to define a unitary mass with the bonding being achieved in accordance with techniques known in the art and being provided simultaneously with the curing of the rectangular sheet against the outside surface 30 of the core 22. The sheet is illustrated in FIG. 13 as a single thickness sheet of substantial thickness as indicated at 64 and such sheet is wound in position in this example so that only one layer thereof is required; however, it will be appreciated that a similar sheet may be of comparatively smaller thickness and wound in position in a plurality of turns or layers which once subsequently cured, in accordance with the techniques known in the art, define a single thickness unitary layer therearound with the rubber turns fusing together and being indiscernible.

Figure 14:
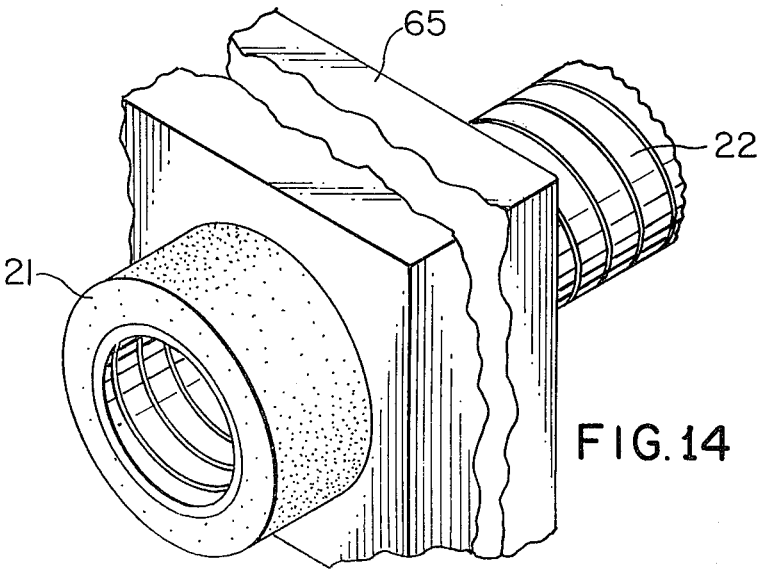
FIG. 14 is a view with parts in cross section and parts broken away particularly illustrating an elongated length of tubular core formed as shown in FIG. 8 being passed through an extrusion die to extrude a seamless rubber sleeve against the outside surface of such core.

The cot 20 may also be defined by taking a continuous length of helically wound core 22 from a supply roll thereof (not shown) or directly from a machine used to make same (also not shown) as illustrated in FIG. 14 and passing such continuous length through die means of the type known in the art and such die means may be in the form of a crosshead extruder 65, or the like, whereupon the elastomeric outer portion 21 is extruded against the tubular core 22 to form an extruded seamless outer sleeve which is defined and bonded against the outside surface 30 of the core 22 in a simultaneous manner.

Figure 11:
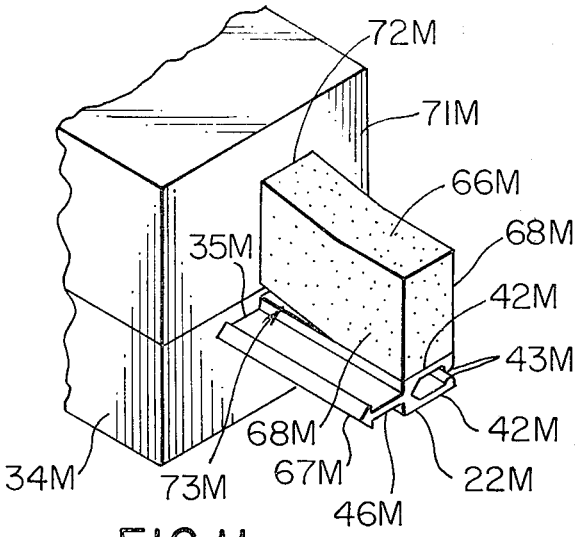
FIG. 11 is a view similar to FIG. 7 wherein an elongated strip substantially identical to the strip of FIG. 7 is extruded through an associated extrusion die simultaneously with an elongated rubber strip of substantially rectangular cross-sectional configuration to define a cot-defining laminated construction.
Figure 12:
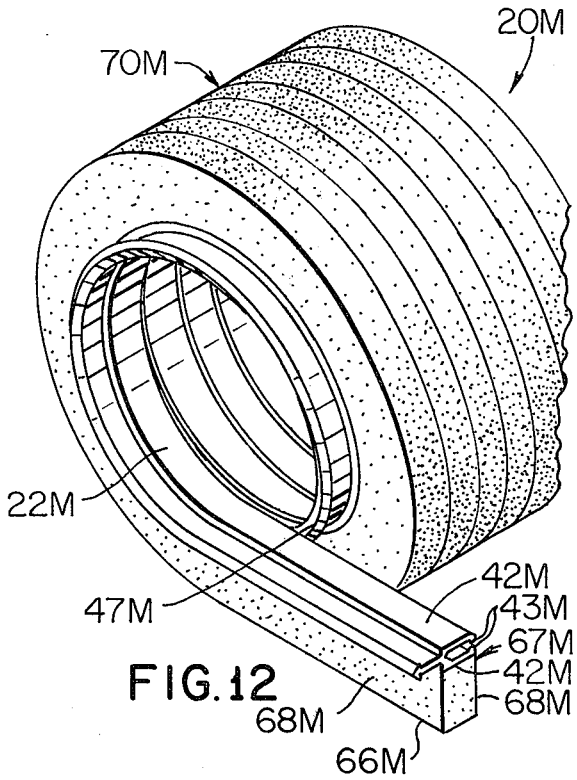
FIG. 12 is a fragmentary perspective view illustrating the manner of winding the construction of FIG. 11 in helical form to simultaneously define a core and an elastomeric outer portion.

Another examplary modification of the cot 20 is illustrated in FIG. 12 of the drawings and designated by the reference numeral 20M. The cot 20M is defined by helically winding an elongated strip or core defining component 22M which is identical to the core 22 and with component 22M having an elongated strip of an elastomeric material such as a rubber material 66M suitably bonded thereagainst. The bonding of strip 66M is achieved against the outside of one of the arms 42M of component 22M and the resulting construction, which is illustrated in FIGS. 11 and 12 and designated by the reference numeral 67M, is suitably wound so that adjoining radially extending surfaces 68M of the strip are arranged in face-to-face contact and as shown at 70M to define the cot 20M. The precise axial length of the cot 20M may be defined using any suitable technique known in the art.

The elongated strip of elastomeric material which is a rubber strip 66M in this example may be suitable bonded against the elongated strip 22M utilizing any suitable technique. For example, the bonding action may be achieved by utilizing a die structure 71M, as shown in FIG. 11, having a die orifice 35M in the die 34M and a rectangular orifice 72M through which the rubber strip 66M is extruded. The extruding action is achieved so that the elongated plastic strip 22M serves as a support for the extruded rectangular strip 66M and as the strips 22M and 67M are brought into face-to-face contact as shown at 73M there is a simultaneous bonding action and the definition of the structure 67M. The structure 67M is then suitably helically wound as shown in FIG. 12. The cot 20M has advantages similar to the advantages of the cot 20 and is capable of being radially expanded a sufficient amount to provide a press fit against an associated cylindrical supporting sroller 23, or the like.

Figure 15:
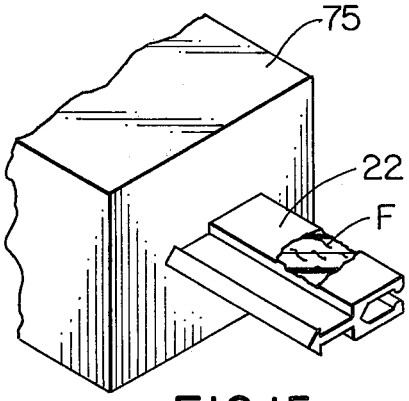
FIG. 15 is a fragmentary view with parts in cross section and parts broken away particularly illustrating an elongated core defining strip being extruded so that it has a plurality of randomly arranged strengthening fibers embedded therein in roughly parallel relation along its length.
Figure 16:
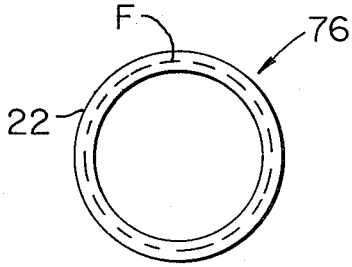
FIG. 16 is a schematic presentation showing the strip of FIG. 15 wound in a helical pattern and showing that the fibers are arranged circumferentially in such core so as to provide improved hoop strength for such core.

The elongated strip 22 may be made by extruding a synthetic plastic material, or the like, through an associated extrusion die 75 such as shown in FIG. 15 with the extrusion die 75 serving to introduce a plurality of randomly arranged strengthening fibers into the elongated strip and the strengthening fibers F are embedded in the strip 22 in roughly parallel and staggered relation along its length so that once the strip 22 is in its helically wound form the fibers, shown schematically at 76 in FIG. 16, provide improved hoop strength for the core 22.

It will also be appreciated that the various elongated strip means 22A, 22B, 22C, and similar strip means may also be suitably provided with elongated fibers F therein to provide improved hoop strength for the cores made using such fiber reinforced strip means.

The elastomeric outer portion comprising each of the cots disclosed herein may be made of any suitable elastomeric material, such as, a synthetic plastic material or a natural or synthetic rubber compound. Further, the core of each of the cots of this invention is preferably an elastomeric material in the form of a thermoplastic material.

While present exemplary embodiments of this invention, and methods of practicing the same, have been illustrated and described, it will be recognized that this invention may be otherwise variously embodied and practiced within the scope of the following claims.

What is claimed is:

1. A textile cot comprising an elastomeric outer portion and a rigid core bonded to and supporting said outer portion, said core comprised of a continuous interlocking tube capable of being expanded radially a sufficient amount to provide a press fit against an associated cylindrical supporting structure, said tube formed of elongated helically wound strip means having mechanically interlocking projections.

2. A cot as set forth in claim 1 in which said strip means is made of an elastomeric material.

3. A cot as set forth in claim 2 in which said strip means comprises a single strip.

4. A cot as set forth in claim 2 in which said strip means comprises a plurality of interlocked strips.

5. A cot as set forth in claim 4 in which said plurality of interlocked strips are defined by a pair of interlocked U-shaped strips.

6. A cot as set forth in claim 3 in which said strip has a cross-sectional configuration approximately similar to a structural Zee.

7. A cot as set forth in claim 2 in which said strip has a cross-sectional configuration approximately similar to the numeral 5.

8. A cot as set forth in claim 2 in which said strip comprises a roughly U-shaped portion defined by a bight and a pair of arms extending from opposite ends of said bight in one direction with said arms having locking projections extending toward each other, and a spear-shaped portion having a shaft with its rear portion fixed to said bight and a head pointed in a direction opposite said one direction, said strip being helically wound so that each turn thereof has the head of its spear-shaped portion received between said arms with said locking projections against opposed surfaces of said shaft.

9. A cot as set forth in claim 8 in which said locking projections are provided at the outer extremities of said arms and have rounded surface portions which engage said shaft therebetween and said arms resiliently compress locking projections against said shaft to provide said locking action.

10. A cot as set forth in claim 2 in which said elastomeric outer portion is in the form of a helically wound elongated strip of substantially rectangular cross-sectional configuration having adjoining radially extending surfaces in face-to-face contact and having a smooth outside surface.

11. A cot as set forth in claim 2 in which said elastomeric outer portion is in the form of a rectangular sheet of a rubber material which is bonded against said core as a unitary mass.

12. A cot as set forth in claim 1 in which said elastomeric outer portion is in the form of an extruded seamless rubber sleeve bonded against the outer surface of said core.

13. A cot as set forth in claim 1 in which said elongated strip means has a plurality of randomly arranged strengthening fibers embedded therein in roughly parallel relation along its length so that once said strip means is in its helically wound condition, said fibers provide improved hoop strength for said core.

14. A cot as set forth in claim 1 in which said elongated strip means is in the form of an elongated plastic strip.

15. A cot as set forth in claim 14 in which said plastic strip has a plurality of randomly arranged strengthening fibers embedded therein in roughly parallel relation along its length so that once said plastic strip is in its helically wound pattern, said fibers provide improved hoop strength for said core.

* * * * *

UNITED STATES PATENT OFFICE
CERTIFICATE OF CORRECTION

PATENT NO. : 3,981,059

DATED : Sept. 21, 1976

INVENTOR(S) : Walter L. Dodson

It is certified that error appears in the above-identified patent and that said Letters Patent are hereby corrected as shown below:

Col. 1, line 13, "agove" should be --- above ---

Col. 1, line 64, "toe" should be --- the ---

Col. 3, lines 22 and 23, delete "having the desired diameter and the winding action may be continued until the" and insert --- along its ---

Col. 3, line 34, after "having" insert --- the desired diameter and the winding action may be continued until ---

Col. 4, line 6, after the word "serve" insert --- to ---

Signed and Sealed this

Thirtieth Day of November 1976

[SEAL]

*Attest:*

RUTH C. MASON
*Attesting Officer*

C. MARSHALL DANN
*Commissioner of Patents and Trademarks*